US006378845B1

(12) United States Patent
Hsu

(10) Patent No.: US 6,378,845 B1
(45) Date of Patent: Apr. 30, 2002

(54) PORTABLE COMBINATION FAN AND HUMIDIFIER

(76) Inventor: Chin-Tien Hsu, No. 3, Alley 15, Lane 54, Fu-Te 2nd Rd., Hsi-Chih City (TW)

( * ) Notice: Subject to any disclaimer, the term of this patent is extended or adjusted under 35 U.S.C. 154(b) by 0 days.

(21) Appl. No.: 09/676,562

(22) Filed: Oct. 2, 2000

(51) Int. Cl.[7] ..... B01F 3/04

(52) U.S. Cl. ..... 261/28; 261/89; 261/DIG. 43; 239/222.11; 239/289; 239/327

(58) Field of Search ..... 261/28, 30, 89, 261/DIG. 3, DIG. 43; 239/222.11, 289, 327, 328, 380

(56) References Cited

U.S. PATENT DOCUMENTS 4,839,106 A * 6/1989 Steiner ..... 261/28
5,338,495 A * 8/1994 Steiner et al. ..... 261/28
5,620,633 A * 4/1997 Junkel et al. ..... 261/28
5,667,732 A * 9/1997 Lederer ..... 261/89
5,715,999 A 2/1998 Hsu
5,752,662 A 5/1998 Hsu
5,837,167 A * 11/1998 Lederer ..... 261/89
5,843,344 A * 12/1998 Junkel et al. ..... 261/89
5,904,882 A * 5/1999 Featherly ..... 261/30
5,965,067 A * 10/1999 Junkel et al. ..... 261/28
6,216,961 B1 * 4/2001 Utter et al. ..... 261/89

* cited by examiner

*Primary Examiner*—C. Scott Bushey
(74) *Attorney, Agent, or Firm*—Birch, Stewart Kolasch & Birch, LLP

(57) ABSTRACT

A portable combination fan and humidifier includes a non-rigid water reservoir, a fan, a fastener for securing the reservoir and fan together, and a holder for facilitating carrying. In use, one hand of a user can hold the reservoir and the housing of the fan to squeeze the reservoir for shooting out a spray. At the same time, the fan is turned on to spray the spray into air. This can enhance environmental conditions.

7 Claims, 8 Drawing Sheets

PORTABLE COMBINATION FAN AND HUMIDIFIER

BACKGROUND OF THE INVENTION

1. Field of the Invention

The present invention relates to a portable fan and more particularly a portable combination fan and humidifier to enhance environmental conditions.

2. Related Art

Atomizers are already widely used. For example, an athlete may use an atomizer to shoot out a fine spray toward their body to cool a bit during rest time. Moreover, an atomizer may be used to shoot out perfume. A conventional portable fan comprises a projected nozzle and an actuator coupled to the front of the nozzle. A user can press the actuator to shoot out a fine spray. In general, the distance of spraying is relatively short. Thus, it usually has a good effect on a number of specification implementations such as detergent spraying, while it does not have a good spraying effect in a windy environment.

Another portable fan comprises a projected actuator and a nozzle adjacent to the actuator. In use, the actuator is simply pressed to shoot out a fine spray. It is also unsatisfactory for a short spraying distance and poor spraying effect.

A conventional portable fan and atomizer device is shown in FIG. 1, wherein the portable fan and atomizer are separate components being put together in a housing. In use, a user has to use one hand to hold the atomizer and the other hand to hold the fan. Then the user presses the actuator of the atomizer to shoot out a fine spray. At the same time, the fan can be turned on to spray the fine spray into the air.

However, this is unsatisfactory for the purpose for which the invention is concerned, for the following reasons:

1. It is inconvenient in use due to the separate components.
2. There is no handle or shoulder strap provided. Thus, a user has to prepare a bag to hold the housing with the fan and atomizer received therein during carrying.

A U.S. Pat. No. 5,715,999 discloses an atomizer wherein the nozzle, in front of the fan, is coupled to a tube in fluid communication with a reservoir. In use, both the atomizer and fan are activated for shooting out a fine spray. This arrangement is also unsatisfactory because it is complex in components, high in cost, and bulky (due to a large reservoir). It is not portable. To the contrary, it is designed to be put on a place. In use, simply take it.

Another U.S. Pat. No. 5,752,662 also discloses an atomizer wherein the nozzle is coupled to a curve tube having one end coupled to a shoulder strap and the other end coupled to the rear of the fan. In use, both the atomizer and fan are activated for shooting out a fine spray. This arrangement is also unsatisfactory because it is complex in components and bulky (due to a large reservoir). It is not portable. To the contrary, it is designed to be put on a place. In use, simply take it.

SUMMARY OF THE INVENTION

It is therefore an object of the present invention to provide a combination of a fan and humidifier which is portable.

It is another object of the present invention to provide a portable combination fan and humidifier for enhancing environmental conditions.

The advantages of the present invention are realized by providing a portable combination fan and humidifier comprising a reservoir means for storing water, a fan means for spraying a fine spray into the air, a fastening means for securing the reservoir means and fan means together, and a holding means for facilitating carrying. In use, one hand holds the reservoir means and the housing of the fan means to squeeze the non-rigid reservoir to shoot out a fine spray. At the same time, the fan of the fan means is turned on to spray the fine spray into the air.

Further scope of applicability of the present invention will become apparent from the detailed description given hereinafter. However, it should be understood that the detailed description and specific examples, while indicating embodiments of the invention, are given by way of illustration only, since various changes and modification within the spirit and scope of the invention will become apparent to those skilled in the art from this detailed description.

BRIEF DESCRIPTION OF THE DRAWINGS

The present invention will become fully understood from the detailed description given hereinbelow and the attached drawings which are given by way of illustration only, and thus are not limitative of the present invention, and wherein.

DETAILED DESCRIPTION OF THE INVENTION

Figure 1:
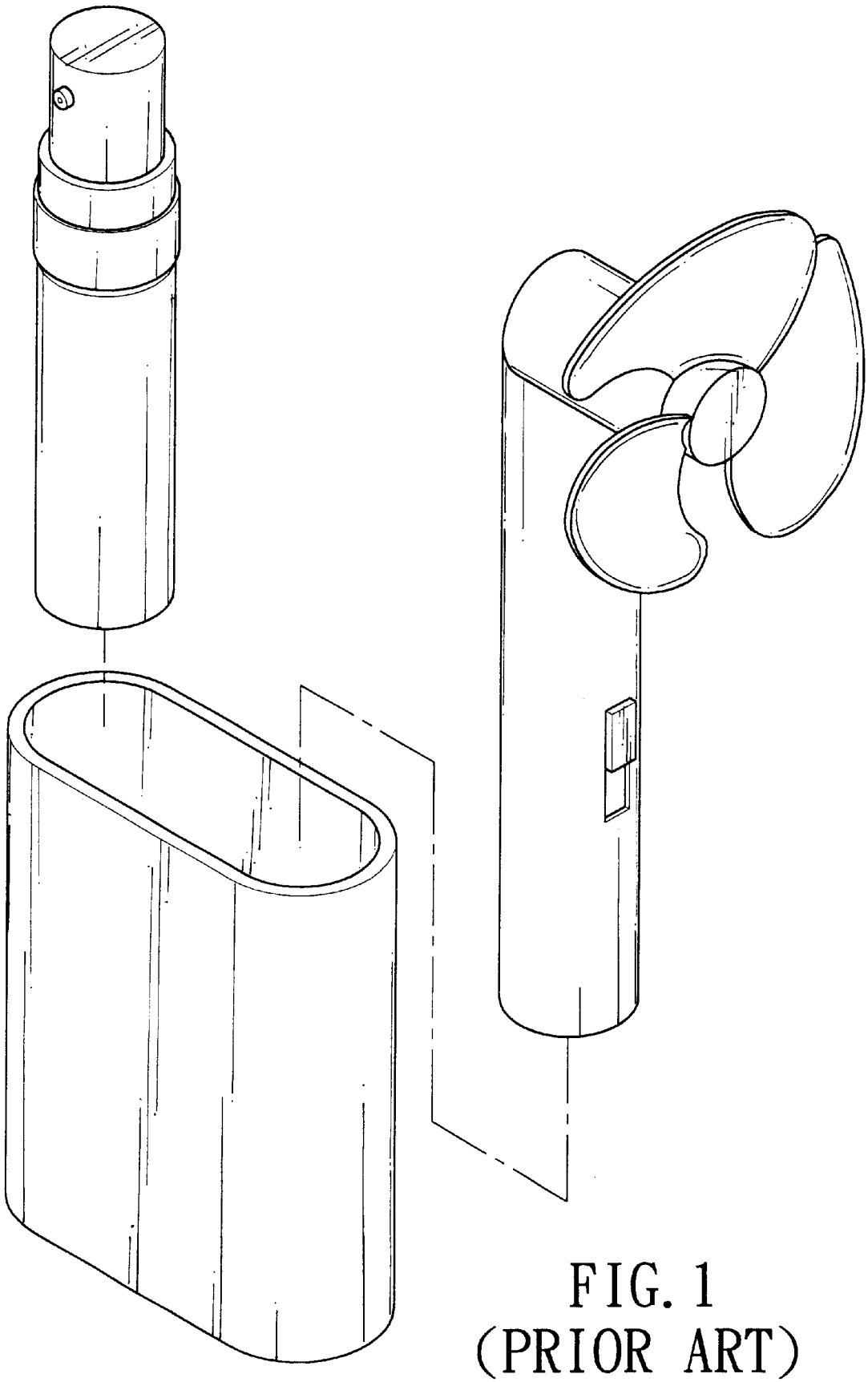
FIG. 1 (PRIOR ART)
FIG. 1 is an exploded view of a conventional combination fan and atomizer.
Figure 2:
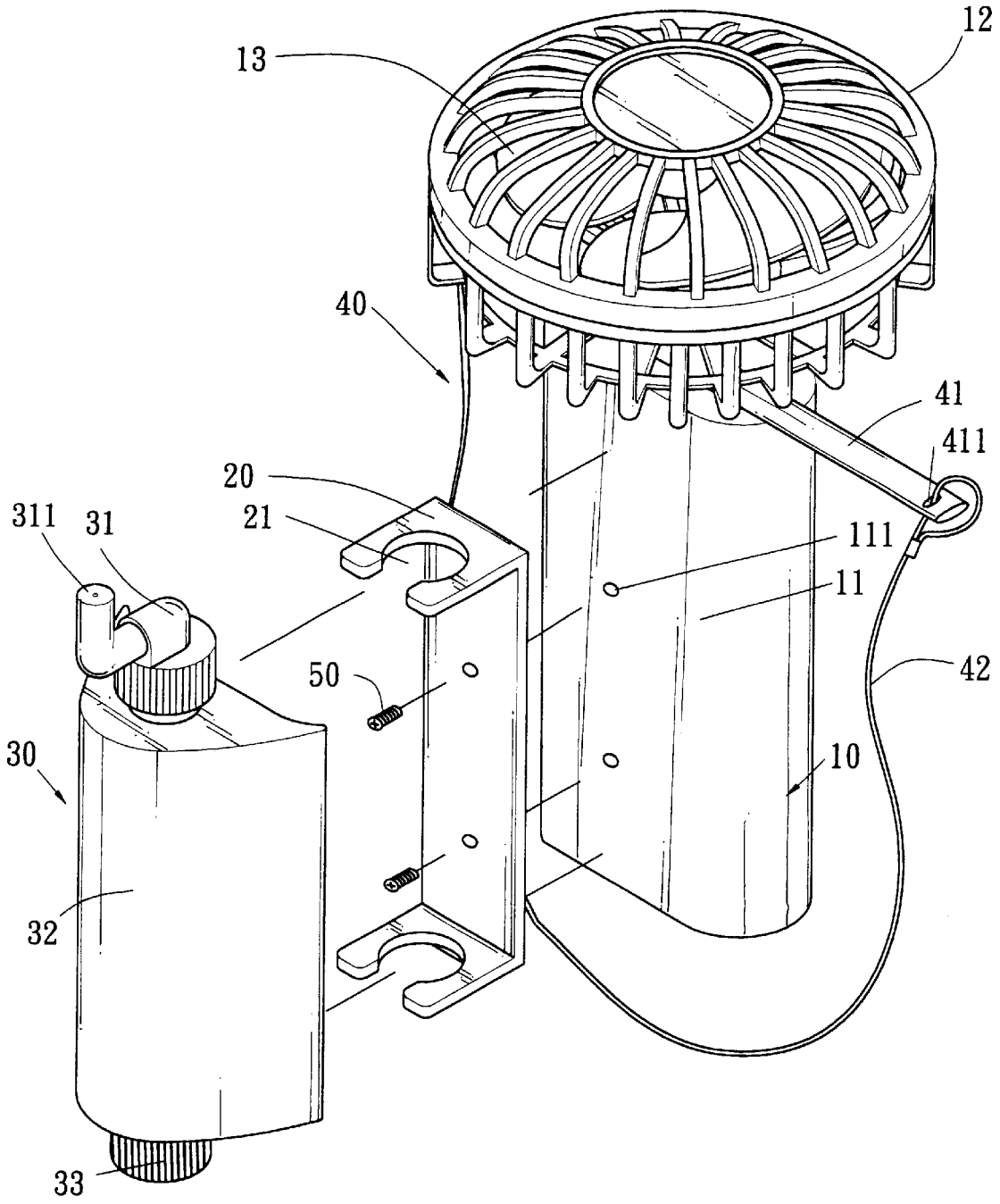
FIG. 2 is an exploded view of a first embodiment of a portable combination fan and humidifier according to the invention.
Figure 4:
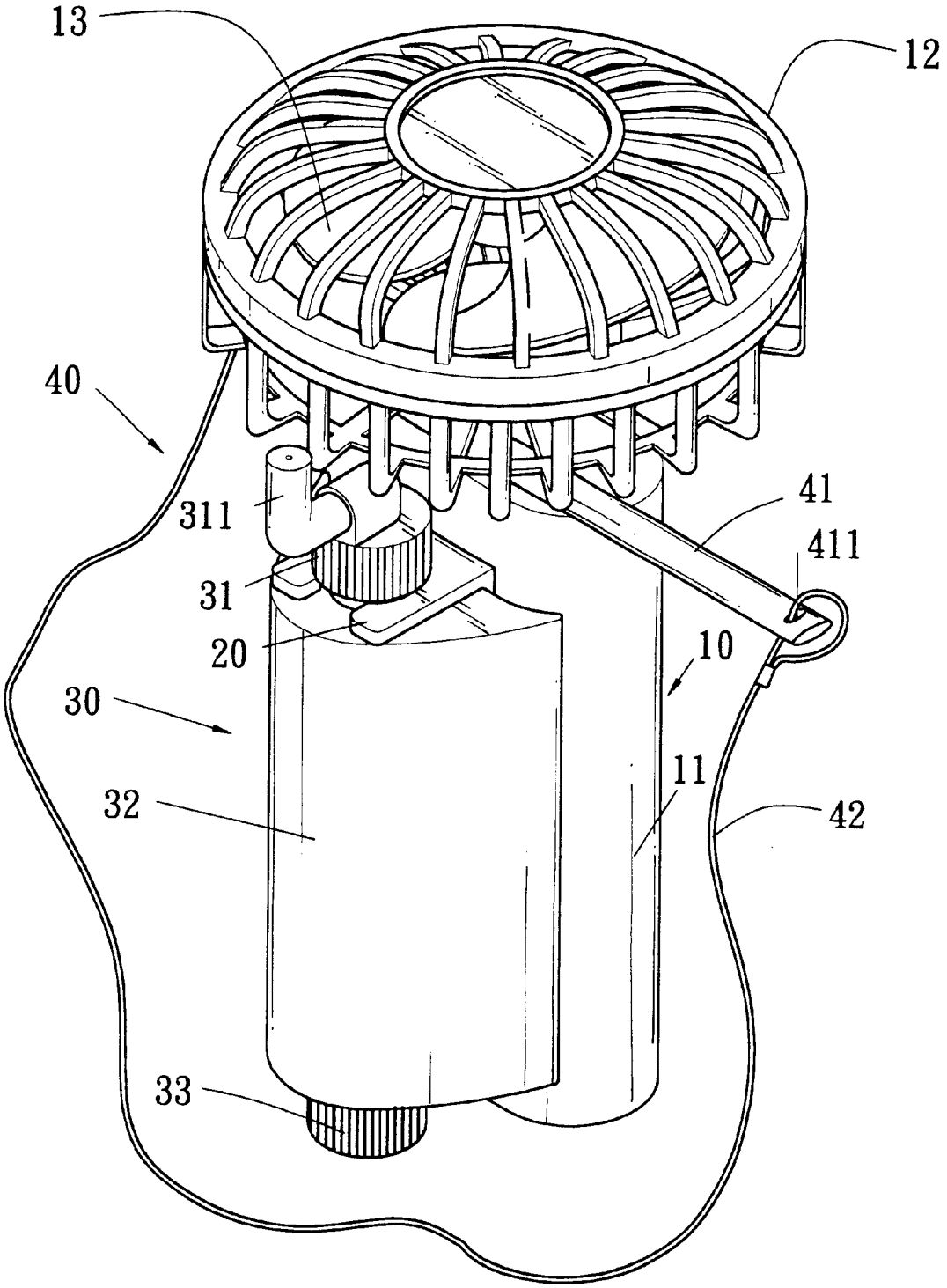
FIG. 4 is a perspective view of the assembled FIG. 2 combination fan and humidifier.

Referring to FIGS. 2 and 4, a portable combination fan and humidifier is shown, constructed in accordance with the invention. This portable combination fan and humidifier comprises a fan means 10, a fastening means 20, a reservoir means 30, and a holding means 40.

Fan means 10 comprises a housing 11 easily grasped by a user's hand. The fan means 10 has a plurality of holes 111, a fan 13 on one end of the housing 11 for spraying mist, and a cover 12 mounted around fan 13.

Fastening means 20 is a J-shaped member comprising a slot 21 on either end and a plurality of screw holes. Screws 50 are threaded through the screw holes and holes 111 for securing fastening means 20 to housing 11.

Reservoir means 30 comprises an L-shaped nozzle assembly 31 having a nozzle 311 adjacent the cover 12 and fan 13, a non-rigid reservoir 32 and a knob 33. The reservoir 32 is made of a flexible plastic material having a curve shape on one side and the other side (i.e., facing housing 11) having a U shape conformed to that of housing 11. Reservoir 32 comprises a top first opening 322 and a bottom second opening 321 for fastening to nozzle assembly 31 and knob 33, respectively. The fasten nozzle assembly 31 is attached to the top slot 21 and knob 33 is attached to the bottom slot 21 respectively, thus securing reservoir means 30 to fastening means 20.

Holding means 40 comprises an elongate bar 41 between housing 11 and fan 13 and a shoulder strap 42. The bar 41 has an aperture 411 in either end for permitting shoulder strap 42 to pass through to form a closed-loop therearound. This shoulder strap 42 greatly improves portability of the invention.

Figure 3:
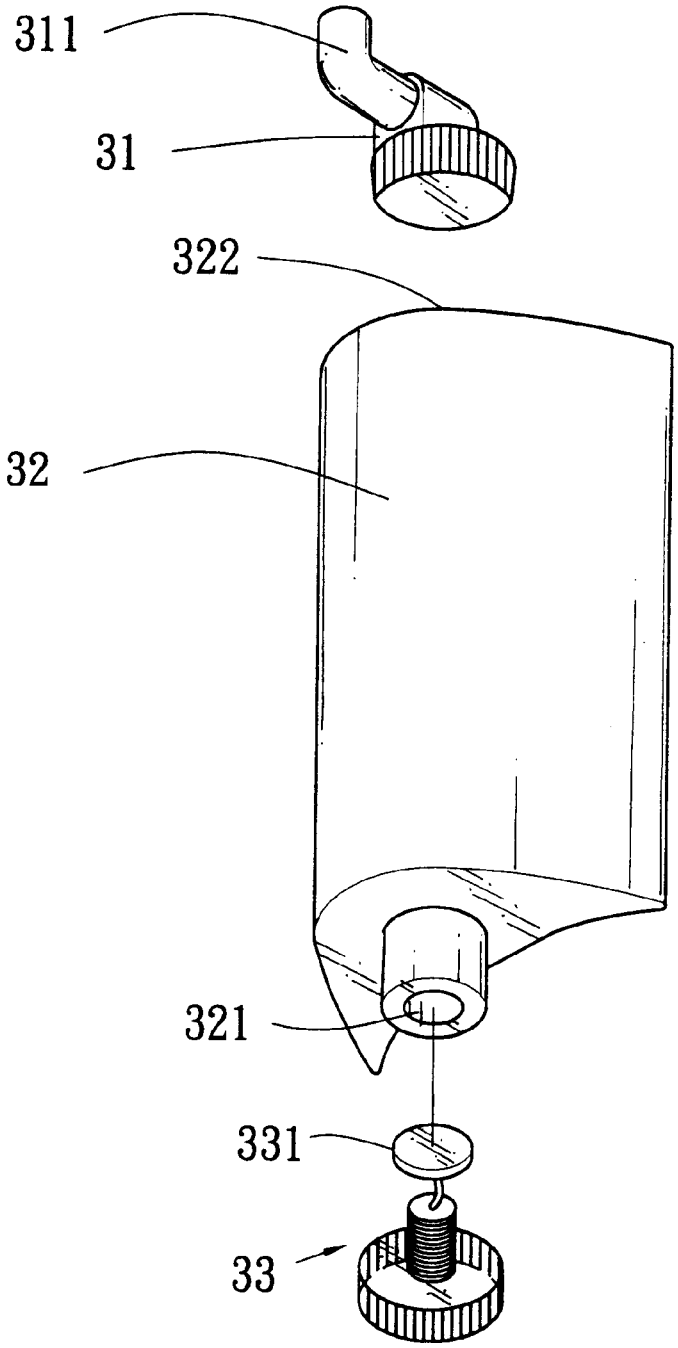
FIG. 3 is an exploded view of the FIG. 2 reservoir means.

Referring to FIG. 3, a user has to loosen knob 33 prior to pouring water into reservoir 32. Knob 33 has a top circular stopper member 331 inside the reservoir 32. The stopper member 331 has a diameter larger than that of the second opening 321 such that a loose knob 33 will not separate from the second opening 321. This can prevent the loss of knob 33 after storing water in reservoir 32.

Figure 5:
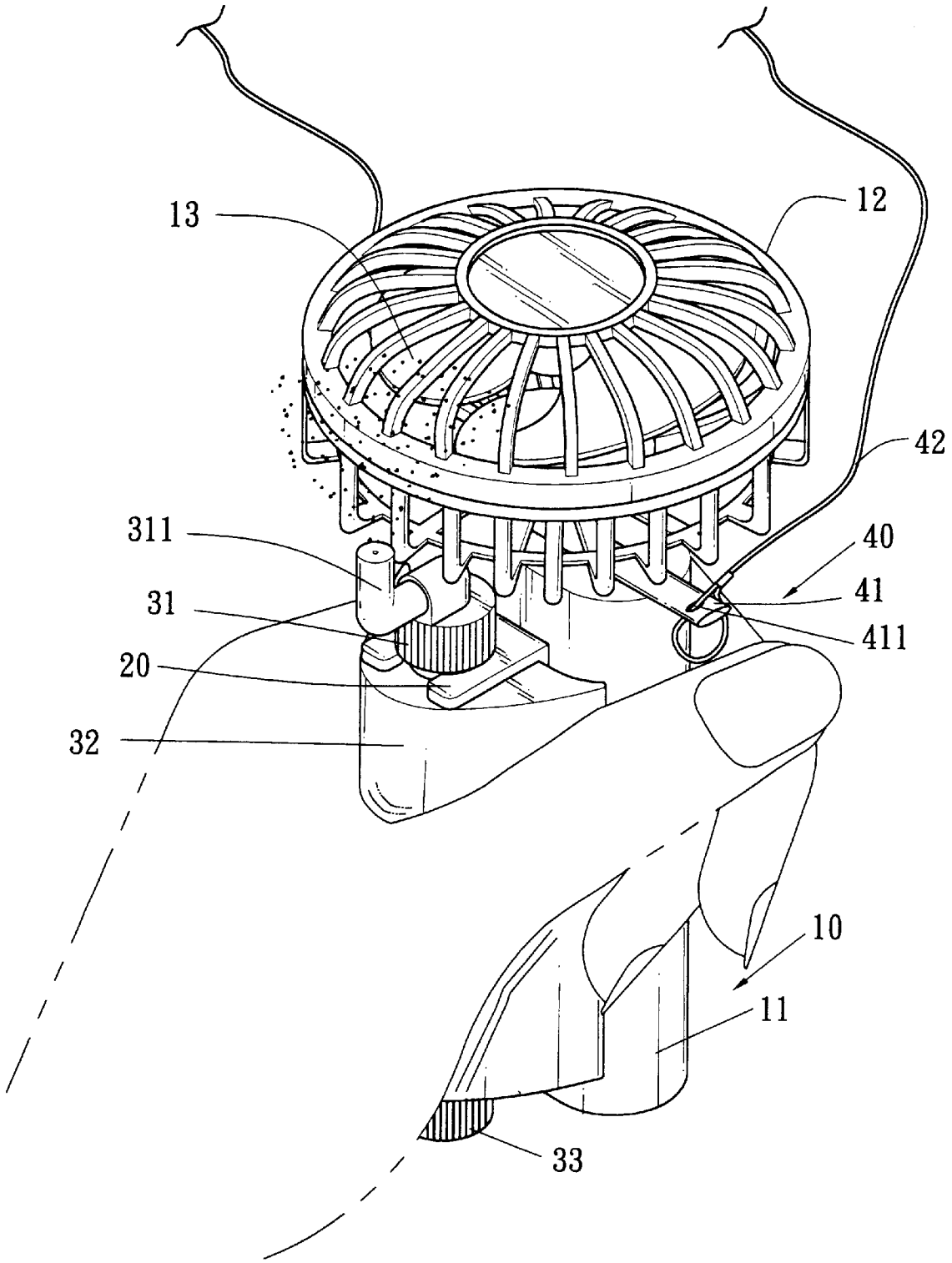
FIG. 5 is an environmental view illustrating the operation of the FIG. 2 combination fan and humidifier.

Referring to FIG. 5, the operation of the FIG. 2 portable combination fan and humidifier will now be described. In use, one hand of a user holds the reservoir means 30 and the housing 11 of fan means 10 to squeeze the reservoir 32 to shoot out a fine spray through the nozzle 311 of nozzle assembly 31. At the same time, the fan 13 of the fan means 10 is turned on to set up a current of air to spray the fine spray toward the user.

Figure 6:
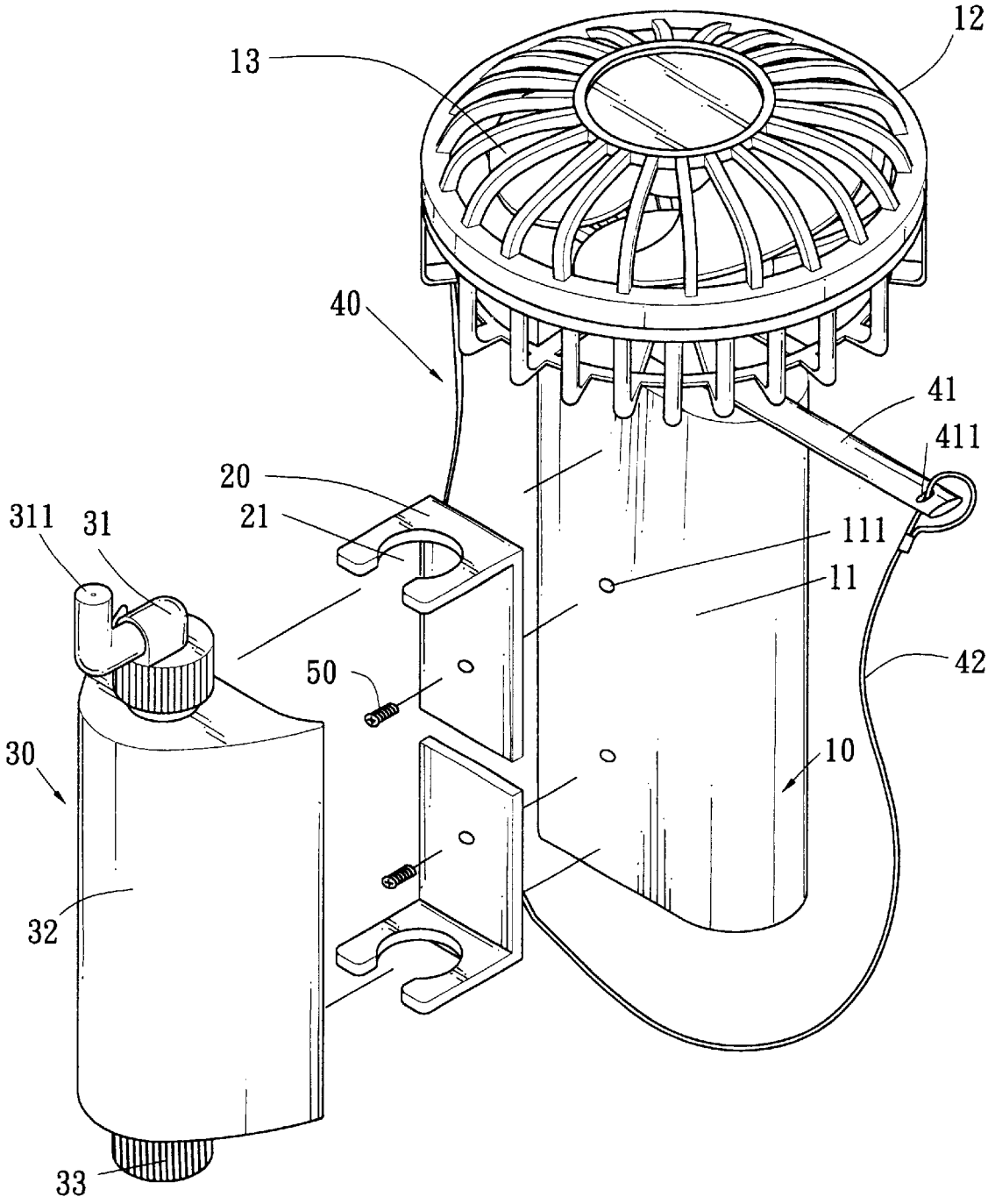
FIG. 6 is an exploded view of a second embodiment of a portable combination fan and humidifier according to the invention.

FIG. 6 is an exploded view of a second embodiment of the portable combination fan and humidifier according to the invention. The difference of this embodiment and the first embodiment is that the fastening means 20 is cut into two separate fastening means 20', each having a screw hole for permitting screw 50 to thread through screw hole and hole 111 for securing fastening means 20' to housing 11. One fastening means 20' has a top slot 21, while the other fastening means 20' has a bottom slot 21 so as to fasten nozzle assembly 31 to the top slot 21 and knob 33 to the bottom slot 21 respectively, thus securing the reservoir means 30 to fastening means 20'.

Figure 7:
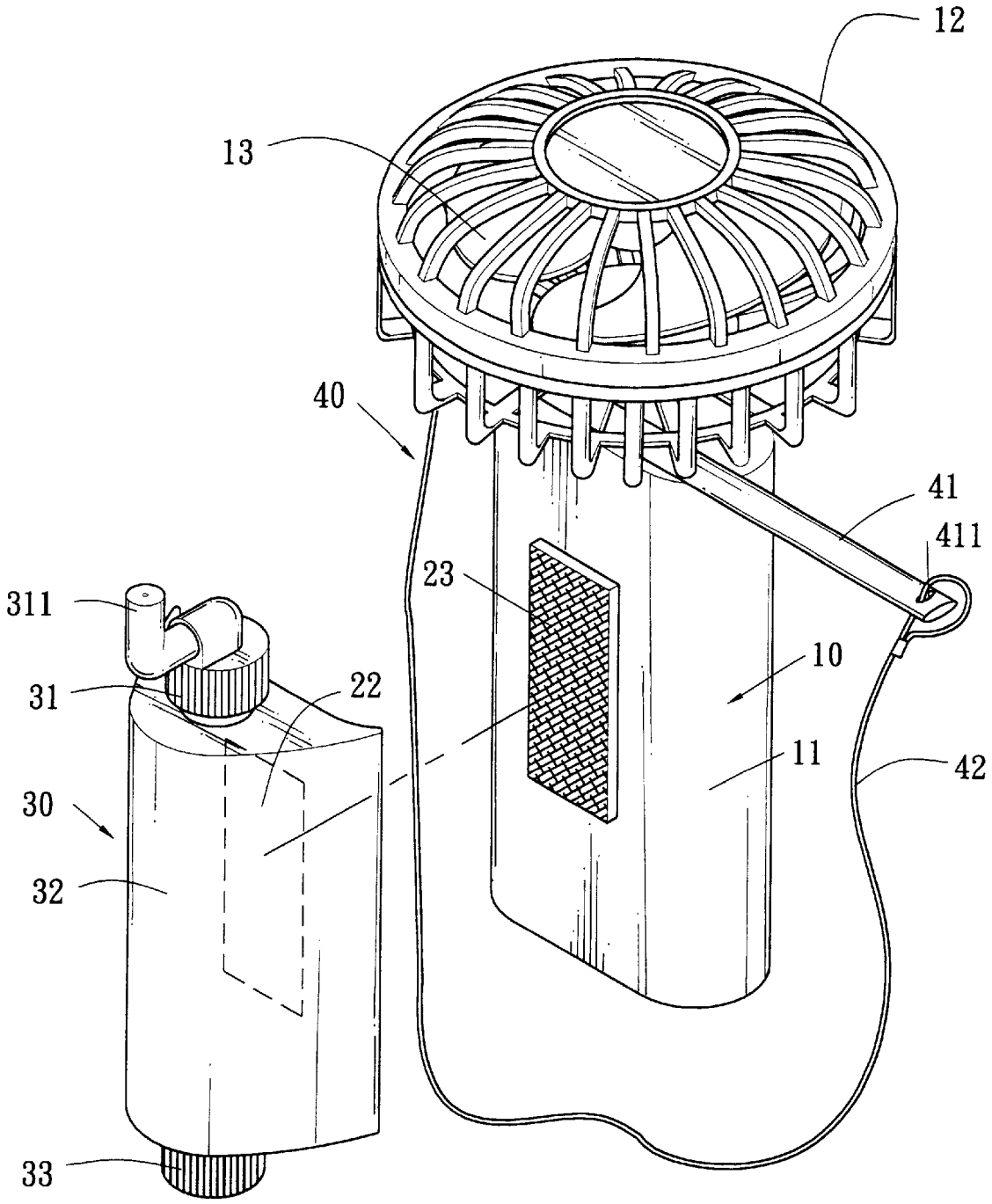
FIG. 7 is an exploded view of a third embodiment of a portable combination fan and humidifier according to the invention.

FIG. 7 is an exploded view of a third embodiment of the portable combination fan and humidifier according to the invention. The difference of this embodiment and the first embodiment is that the fastening means 20 is implemented as a Velcro™ type or hook and loop fastener 22 affixed to reservoir 32 and a mating Velcro™ type or hook and loop fastener 23 affixed to housing 11, thus ensuring a quick fastening of reservoir means 30 to housing 11.

Figure 8:
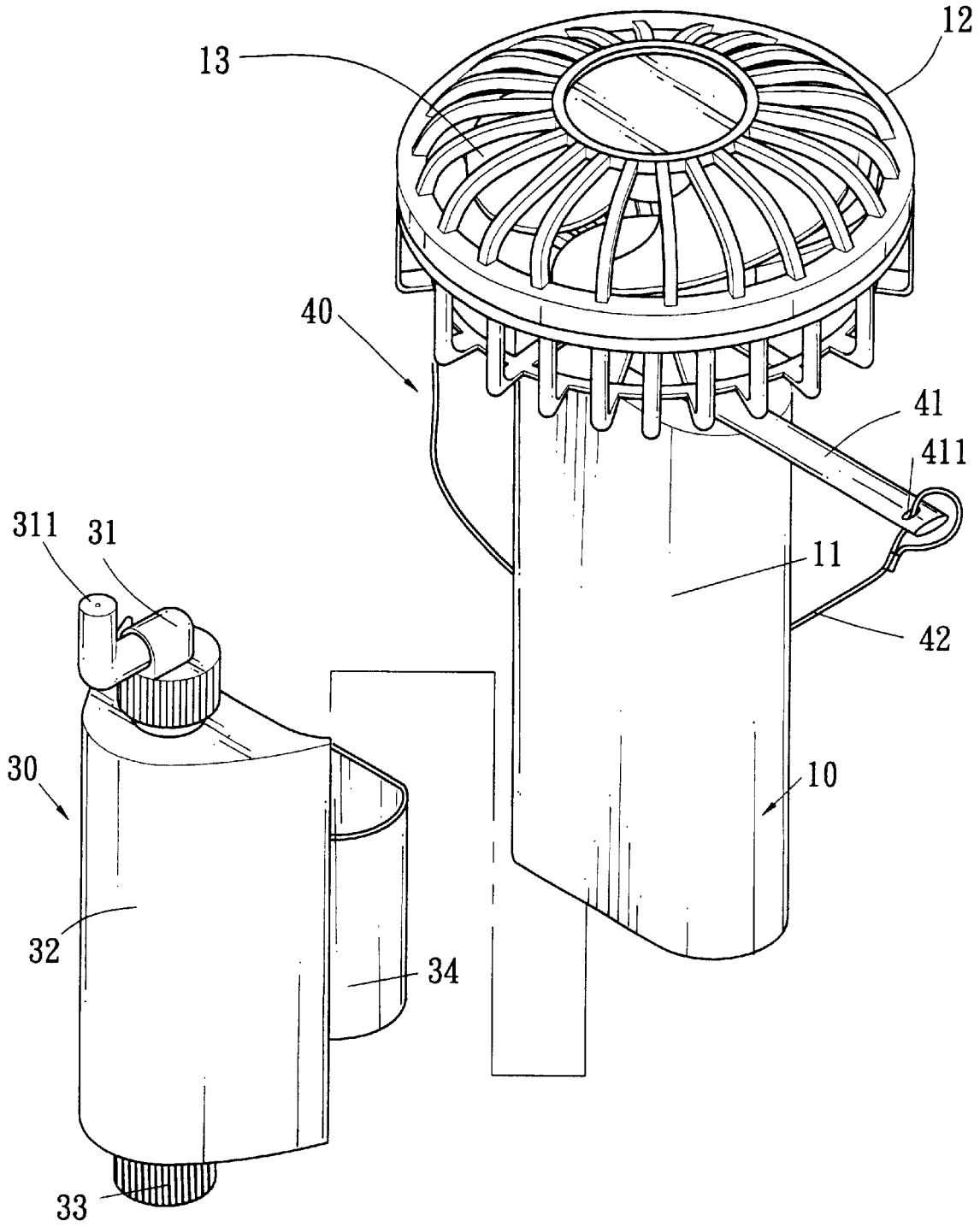
FIG. 8 is an exploded view of a fourth embodiment of a portable combination fan and humidifier according to the invention.

FIG. 8 is an exploded view of a fourth embodiment of the portable combination fan and humidifier according to the invention. The difference of this embodiment and the first embodiment is that the fastening means 20 is replaced by a cup-like member 34 integrally formed with reservoir 32. As such, the housing 11 can be inserted in and secured to the cup-like member 34.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A portable combination fan and humidifier comprising:

fan means having a housing and a fan on one end of the housing;

at least one fastening means releasably coupled to the housing; and reservoir means releasably coupled to the fastening means, the reservoir means having a non-rigid reservoir and a nozzle assembly on one end, the nozzle assembly having a nozzle adjacent an edge of the fan;

wherein the portable combination fan and humidifier is grippable in one hand of a user with the reservoir being squeezable to propel spray from the reservoir towards the fan.

2. The portable combination fan and humidifier as recited in claim 1, wherein the reservoir means further comprises a knob secured to the reservoir and wherein the fastening means comprises a J-shaped fastener having slots on both ends for receiving the nozzle assembly and the knob respectively.

3. The portable combination fan and humidifier as recited in claim 1, wherein the reservoir means further comprises a knob secured to the reservoir and wherein the fastening means has slots on both ends for receiving the nozzle assembly and the knob respectively.

4. The portable combination fan and humidifier as recited in claim 1, wherein fastening means is a two piece structure.

5. The portable combination fan and humidifier as recited in claim 1, wherein the fastening means comprises a hook and loop fastener.

6. A portable combination fan and humidifier comprising:

fan means having a housing and a fan on one end of the housing; and reservoir means releasably coupled to the housing, the reservoir having a non-rigid reservoir and a nozzle assembly on one end, the nozzle assembly having a nozzle adjacent an edge of the fan;

wherein the portable combination fan and humidifier is grippable in one hand of a user with the reservoir being squeezable to propel spray from the reservoir towards the fan.

7. The portable combination fan and humidifier as recited in claim 6, wherein the reservoir means further has a knob secured to the reservoir.

* * * * *